US005753568A

United States Patent [19]

Shimano et al.

[11] Patent Number: 5,753,568

[45] Date of Patent: May 19, 1998

[54] MOISTURE-PERMEABLE, WATERPROOF FABRIC AND ITS PRODUCTION PROCESS

[75] Inventors: Yasunao Shimano; Masashi Mukai; Hideki Chatani; Kazuhiko Takashima; Yoshihiro Umezawa; Dai Hara, all of Ishikawa, Japan

[73] Assignee: Komatsu Seiren Co., Ltd., Ishikawa, Japan

[21] Appl. No.: 757,637

[22] Filed: Dec. 2, 1996

Related U.S. Application Data

[63] Continuation-in-part of Ser. No. 356,347, Dec. 22, 1994, Pat. No. 5,626,950.

[30] Foreign Application Priority Data

| | | | |
|---|---|---|---|
| Apr. 28, 1993 | [JP] | Japan | 5-103043 |
| Jun. 29, 1993 | [JP] | Japan | 5-159326 |
| Jun. 29, 1993 | [JP] | Japan | 5-159336 |

[51] Int. Cl.[6] ..... B32B 27/04; B32B 27/08; B32B 27/12; B05D 5/00

[52] U.S. Cl. ..... 442/64; 442/66; 442/71; 442/76; 442/85; 442/86; 442/88; 427/407.1

[58] Field of Search ..... 442/64, 66, 71, 442/76, 85, 86, 88; 427/407.1

[56] References Cited

U.S. PATENT DOCUMENTS

| | | | |
|---|---|---|---|
| 4,079,285 | 3/1978 | Emmons et al. | 260/29.6 NR |
| 4,834,764 | 5/1989 | Deiner et al. | 8/115.64 |

FOREIGN PATENT DOCUMENTS

| | | |
|---|---|---|
| 0 231 927A3 | 12/1987 | European Pat. Off. . |
| 58-144178 | 8/1983 | Japan . |
| 60-173178 | 9/1985 | Japan . |
| 60-180776 | 9/1985 | Japan . |
| 2-104771 | 4/1990 | Japan . |
| 2-99671 | 4/1990 | Japan . |
| 3-8874 | 1/1991 | Japan . |
| 3-27184 | 2/1991 | Japan . |
| 4-146275 | 2/1992 | Japan . |

*Primary Examiner*—Kathleen Choi

*Attorney, Agent, or Firm*—Burns, Doane, Swecker & Mathis, L.L.P.

[57] ABSTRACT

A moisture-permeable, waterproof fabric comprising a textile fabric and a resin coating containing a fluorine-containing polyurethane resin and polyurethane resin having a low degree of polymerization on at least one side of said textile fabric. This moisture-permeable, waterproof fabric is obtained by a process comprising coating a resin solution, containing a fluorine-containing polyurethane resin and a polyurethane resin having a low degree of polymerization, on at least one side of a textile fabric, followed by coagulating the resin, removing the solvent, drying the fabric and applying a water repellent.

9 Claims, No Drawings

MOISTURE-PERMEABLE, WATERPROOF FABRIC AND ITS PRODUCTION PROCESS

This application is a divisional of application Ser. No. 08/356,347, filed Dec. 22, 1994, now U.S. Pat. No. 5,626, 950.

TECHNICAL FIELD

The present invention relates to a moisture-permeable, waterproof fabric and its production process. More particularly, the present invention relates to a water-permeable, waterproof fabric having high moisture permeability and water resistance, as well as excellent washing durability and moisture condensation and its production process inhibition.

BACKGROUND ART

Known processed fabrics having moisture permeability and water resistance in the prior art consist of a coating of a polyurethane resin on a fabric and have cells formed in the resin coating, by wet coagulation, as disclosed in Japanese Unexamined Patent Publication (Kokai) No. 58-144178.

However, because moisture permeability and water resistance are reciprocal functions, in the above-mentioned prior art where the coating is a polyurethane resin, it is difficult to improve both functions. For example, when the moisture permeability was set at 4,000 $g/m^2/24$ hours, it was not possible to obtain a processed fabric having a water resistance pressure of 2,000 $mmH_2O$.

In order to improve on this point, the use of a film of a mixture of polyurethane resin and polyamino acid-modified urethane resin which was wet coagulated after mixing is proposed in, for example, Japanese Unexamined Patent Publication (Kokai) No. 60-173178. According to this proposal, a processed fabric is obtained having moisture permeability of at least 7,000 $g/m^2/24$ hours and a water resistance pressure of at least 1,500 $mmH_2O$.

In addition, the use of a film of a mixture of fluororesin copolymer, composed by using fluororubber for the base polymer, and polyurethane resin which was wet coagulated after mixing is proposed in, for example, Japanese Unexamined Patent Publication (Kokai) No. 2-99671. According to this proposal, a processed fabric is obtained having moisture permeability of 9,000–13,000 $g/m^2/24$ hours and a water resistance pressure of at least 1,500 $mmH_2O$.

However, in the technology which uses a resin coating composed by mixing the above-mentioned polyamino acid denatured urethane resin and polyurethane resin, although moisture permeability is 4,000–10,000 $g/m^2/24$ hours, water resistance pressure is on the order of 3,000–4,000 $mmH_2O$. Moreover, in addition to the wear resistance of the resin film being inferior, the washing durability is remarkably inferior. Namely, a decrease in water resistance and separation strength is observed as a result of washing, thus preventing this resin film from withstanding practical use.

In addition, in the technology which uses a resin coating composed by mixing a fluororesin copolymer, composed by using fluororubber for the base polymer, and polyurethane resin, although the moisture permeability is 9,000–13,000 $g/m^2/24$ hours, the water resistance pressure was on the order 20 of 2,000–3,000 $mmH_2O$. Moreover, when the proportion of fluororesin copolymer is increased, its compatibility with polyurethane resin becomes poor, resulting in inferior workability and productivity.

DISCLOSURE OF THE INVENTION

In order to solve the problems of the prior art as described above, the object of the present invention is to provide an excellent moisture-permeable, waterproof fabric in which rotting and leakage do not occur even when work is performed in environments of strong wind and rain as well as during strenuous exercise. Moreover, the object of the present invention is to provide a moisture-permeable, waterproof processed fabric having excellent workability and productivity wherein washing durability is excellent and there is good compatibility between a fluorine-containing polyurethane resin and a polyurethane resin during processing and a preparation process.

Thus, the present invention provides a moisture-permeable, waterproof fabric comprising a textile fabric and a resin coating containing a fluorine-containing polyurethane resin and polyurethane resin having a low degree of polymerization on at least one side of said textile fabric.

In addition, the present invention also provides a process for preparing a moisture-permeable, waterproof fabric comprising coating a resin solution, containing a fluorine-containing polyurethane resin and a polyurethane resin having a low degree of polymerization, on at least one side of a textile fabric, coagulating the mixture, removing the solvent, drying, and applying a water repellent treatment.

BEST MODE FOR CARRYING OUT THE INVENTION

Examples of materials of the textile fabric useful in the present invention include synthetic or semi-synthetic fibers such as polyester, polyamide and rayon, natural fibers such as cotton and wool, as well as blends of these. In addition, these fibers may be in any form, such as woven fabric, knitted fabric or non-woven fabric.

The fluorine-containing polyurethane resin used in the present invention refers to a resin in which fluorine is copolymerized in a known polyurethane resin component, and examples of its preparation process are as described below.

The first process consists of copolymerizing an acrylic resin, which contains a fluoroalkyl group and a hydroxyl group in its molecule and can be polymerized with polyurethane resin, in the components of a urethane resin.

In this process, examples of the acrylic resin include polymers containing, for example, an acrylate or a methacrylate having a fluoroalkyl group or acrylate or methacrylate having a hydroxyl group, for its comonomer component, that is composed by polymerizing monomers having an $\alpha,\beta$-unsaturated ethylenic bond. Examples of the monomers include acrylate, methacrylate or their derivatives, namely esters of acrylate or methacrylate and methanol, ethanol, propanol, butanol, octyl alcohol, cyclohexanol, etc., acrylamide or methacrylamide, acrylonitrile and styrene for the comonomer component other than that indicated above, by using peroxide and an azo-based radical polymerization initiator. This acrylic copolymer is then copolymerized during the synthesis of urethane resin to obtain a fluorine-containing polyurethane resin.

Next, a second process is described below wherein a fluorine-containing compound having two active hydrogen groups is copolymerized in a urethane resin component.

In this process, examples of fluorine compounds having two active hydrogen groups include 3-(2-perfluorohexyl) ethoxy-1,2-dihydroxypropane, perfluorooctylsulfonamide, 2,2-bis(4-hydroxyphenyl)hexafluoropropane, 2,2-bis[4-(4-aminophenoxy)phenyl]hexafluoropropane, 1,3-bis(2-hydroxyhexafluoroisopropyl)benzene or mixtures of two or more types of these. This fluorine-containing compound is then copolymerized during the synthesis of urethane resin to obtain a fluorine-containing polyurethane resin.

Moreover, another process involves copolymerization of a fluorine-containing compound, having a fluoroalkyl group and at least one active hydrogen, to the terminal group of a urethane resin component. In this process, examples of the fluorine-containing compound having a fluoroalkyl group and at least one active hydrogen include trifluoroethanol, N-n-propyl-N-perfluorooctane sulfonate amide ethanol, hexafluoroisopropanol, o- or p-trifluoromethylbenzyl alcohol, fluorinated alcohol ethylene oxide addition products or mixture of two or more types of these. This fluorine-containing compound is then copolymerized to the terminal group of a urethane resin component during the synthesis of urethane resin to obtain a fluorine-containing polyurethane resin.

In the case of coagulating a dimethylformamide solution of this fluorine-containing polyurethane resin in water, the coagulation rate of the hard segment, which is composed of a chain lengthener in the resin, and the fluorine-containing segment is greater than the coagulation rate of the soft segment composed of a high molecular weight diole. Consequently, strain occurs between molecules during formation of micropores. This has the effect of increasing the fineness of the respective micropores and making them more uniform, thus giving a structure that is advantageous for permeation of water vapor.

However, in the case of using this resin alone, water resistance pressure reaches a maximum of roughly 4,000 $mmH_2O$, and this value decreases by more than half as a result of washing. In addition, depending on the type of fabric, separation strength may be less than 100 g/cm, thus preventing practical use.

Although known polyester-based polyurethane resins can be used as the polyurethane resin, having a low degree of polymerization, in the present invention, its number average molecular weight is preferably 1,000–50,000. In terms of the properties of a single-liquid urethane resin, this degree of polymerization is near the limit with respect to the ability to form a coating.

By blending in this type of polyurethane resin having a low degree of polymerization, water resistance and adhesion to the fabric, which are deficient in the case of the fluorine-containing urethane resin alone, can be improved.

Mainly water-soluble, polar organic solvents, examples of which include dimethylformamide (DMF), dimethylacetoamide and N-methylpyrrolidone, are selected for use as organic solvents used as solvents of the above-mentioned fluorine-containing polyurethane resin and polyurethane resin having a low degree of polymerization based on resin solubility, ease of coagulation and removal of solvent. The amount of solvent used is preferably within a range of 20–100 parts by weight to 100 parts by weight of a blend of the base resins having a solid portion of 20–40%. If below this range, although water resistance and adhesion to the fabric are improved, moisture permeability decreases and the texture becomes hard.

The mixing ratio of the above-mentioned fluorine-containing polyurethane resin and polyurethane resin having a low degree of polymerization is preferably selected within a range of 100:5 to 50:50 in terms of the weight ratio. If the weight ratio of polyurethane resin to fluorine-containing polyurethane resin is less than 100:5, water resistance and adhesion to the fabric decrease, thus preventing the fabric from being used practically. In addition, if the ratio is greater than 50:50, although water resistance and adhesion to the fabric are improved, moisture permeability decreases.

Any of the various types of additives that are added to polyurethane resin for wet film formation may be added to the above-mentioned resin mixture as desired. Examples of the additives include inorganic or organic fine powders, water-soluble surface activators and isocyanate crosslinking agents such as aluminum hydroxide, colloidal silica and cellulose.

The resin coating obtained in the above-mentioned process demonstrates a three layer structure consisting of the formation of fine cells not found in the prior art in the surface portion, the formation of cells uniform in both size and shape in the central portion, and the formation of even finer cells in the interface portion with the fabric.

As a result of having the above-mentioned cell structure in the resin coating, the moisture-permeable, waterproof fabric of the present invention provides high water resistance in the form of a water resistance pressure of more than 6,000 $mmH_2O$, and high moisture permeability in the form of water vapor permeability of more than 8,000 $g/m^2/24$ hours as determined by the calcium chloride method. Moreover, the amount of moisture condensation is less than 30 $g/m^2/hr$, thereby demonstrating excellent moisture condensation inhibition. In addition, due to the presence of fine cells in the interface portion with the fabric, the resulting moisture-permeable, waterproof fabric also demonstrates high separation strength and a water resistance pressure retention ratio of better than 70% after washing.

Moreover, in cases requiring even higher levels of water resistance such for use in mountaineering , this fabric may also have a non-porous film having as its major component a polymer material having a water swelling property in addition to the above-mentioned fluorine-containing polyurethane resin and polyurethane resin having a low degree of polymerization.

The material used for the water swelling polymer material preferably swells in the presence of water and has a degree of linear water swelling of 5–40%. Moreover, this material should also exhibit thermocompressibility. More specifically, although polyurethane resin having this type of performance is used preferably, there are no particular limitations on the material used provided it has said function. An example of a method for providing the material by thermocompression bonding includes the addition of a low melting point polyurethane resin or an isocyanate-based crosslinking agent.

Thus, the moisture-permeable, waterproof fabric having a resin film layer comprised of two layers consisting of a fine porous layer, composed of a mixture of a fluorine-containing polyurethane resin and a polyurethane resin having a low degree of polymerization, and a non-porous film having for its main component a polymer material that swells in the presence of water, features improved moisture permeability and water resistance. The water vapor permeability as determined by the potassium acetate method is better than 10,000 $g/m^2/24$ hours, the water vapor permeability as determined by the calcium chloride method is better than 3,000 $g/m^2/24$ hours, and the water resistance pressure is better than 30,000 $mmH_2O$. In addition, it also demonstrates moisture condensation inhibition in the form of an amount of moisture condensation of less than 30 $g/m^2/hr$, as well as a water resistance pressure retention ratio after washing of better than 70%.

Here, a description of the difference between water vapor permeability as measured by the calcium chloride method and that measured by the potassium acetate method is provided. In the case of the calcium chloride method, the ease with which water vapor moves from a very moist area within clothing to a dry area outside clothing is measured. In the potassium acetate method, the ease with which water droplets on to the inside of clothing are moved outside the clothing is measured. In consideration of the degree of comfort inside the clothing, although it is necessary for a material to have performance that enables it to rapidly move large amounts of moisture from inside clothing to outside the clothing, no matter how fast the rate of release, water droplets end up forming on the inside of the clothing fabric. Thus, it is necessary to allow the formed water droplets to move outside the clothing. Accordingly, water vapor permeability using the calcium acetate method is important in consideration of comfort.

The following provides an explanation of the production process of the moisture-permeable, waterproof fabric of the present invention. Prior to forming a resin coating by wet coagulation, a water repellent treatment, a calender treatment or both may be performed on the textile base material in advance to prevent the resin solution from penetrating excessively into the textile base material that composes the fabric.

Formation of the fine porous film composed of a mixture of fluorine-containing polyurethane resin and polyurethane resin having a low degree of polymerization can be performed by coating a polar organic solvent solution of this resin mixture onto a textile base material. Examples of useful polar organic solvents include dimethylformamide and dimethylacetoamide.

Coating of the mixed resin solution can be performed by a known means such as a knife over roll coater. Next, the resin is coagulated by immersing the coated material in water to form a fine porous film. The coagulation solution consists of water or an aqueous solution of solvent, and coagulation is performed at a liquid temperature of 5°–60° C. Next, washing with warm water is performed at 5°–80° C. to remove the solvent followed by drying at 90°–140° C. using an air oven or a hot cylinder.

The coated amount should be 10–80 g/m$^2$ after drying, and the film thickness should be 10–40 μm. If less than 10 μm, fibers will protrude from the fine porous film. This is not desirable since there are cases in which this causes thermocompression bonding with the non-porous film to become unstable. Water repellent treatment may be performed after solvent removal and drying to give durable water repellency. Known water repellents can be used for this water repellent treatment. Moreover, it is desirable to perform finishing setting from the viewpoint of improving the quality of the fabric finished product.

In addition, the resin coating containing a water swelling polymer material can be produced according to the processes described below.

(1) In this process, a mixed resin solution having for its main component a polymer material that swells in the presence of water is coated onto mold releasing paper and dried. Next, after applying adhesive, a laminating process, that includes thermocompression bonding is used to produce a textile base material having a fine porous film.

(2) In this process, a mixed resin solution having as its main component a polymer material that swells in water and is thermocompressible is coated onto mold releasing paper. After drying, a lamination process is used that includes thermocompression bonding the mixed resin onto a fiber material fabric having a fine porous film layer.

(3) In this process, a coating process is used wherein a mixed resin solution having for its main component a polymer material that swells in water is coated onto a textile base material, having a fine porous film layer, and dried.

In the lamination processes, a mixed resin solution having as its main component a polymer material that swells in water and which is diluted with an organic solvent is coated onto the entire surface of mold releasing paper. Examples of organic solvents that can be used at this time include methyl ethyl ketone, dimethylformamide, toluene, ethyl acetate and isopropyl alcohol. Isocyanate-based crosslinking agents or surface activators, plasticizers such as ethyl acetate dioctylphthalate, and inorganic or organic fine powders such as calcium carbonate, colloidal silica, cellulose and protein may be added as desired to this mixed resin solution. In addition, the thickness of the resin film at this time should be roughly 3–20 μm. If the film thickness is less than 3 μm. It is difficult to obtain a uniform film surface and thickness for using the mold releasing paper. On the other hand, if greater than 20 μm, moisture permeability is remarkably decreased. Coating of the mixed resin solution can be performed by known means such as a knife over roll coater.

The mixed resin solution that has been coated onto the mold releasing paper is dried at a temperature of roughly 100°–160° C. using an air oven and so forth to form a non-porous film. Next, in the case that the non-porous film has thermocompressibility, this non-porous film is preheated at a temperature of 20°–140° C. followed by thermocompression bonding onto the fine porous film surface of the fiber material fabric having the fine porous film at a temperature of 100°–160° C. and pressure of at least 1 kg/cm$^2$ suitably selected according to the heat resistance and so forth of the fiber material, non-porous film or fine porous film. In the case the non-porous film does not have thermocompressibility, a moisture-permeable adhesive is applied in dots, lines or over the entire surface onto the resulting non-porous film followed by drying or semi-drying at a temperature of 100°–160° C. Next, the film is thermocompression bonded onto the fine porous film surface of the fiber material fabric having the fine porous film at a temperature of 100°–160° C. and a pressure of at least 1 kg/cm$^2$. Next, after aging the thermocompression bonded material for up to 20 hours, the mold releasing paper is peeled off. Pre-heating before thermocompression bonding may be performed as necessary, but it not always required.

Next, a water repellent treatment is performed according to ordinary methods using a fluorine-based water repellent or a silicon-based water repellent or another water repellent as desired, after which finishing setting is performed for removing wrinkles and adjusting specifications at 100°–150° C. to obtain a moisture-permeable, waterproof fabric. In addition, paper treatment and so forth may be performed after water repellent treatment as necessary.

In addition, while providing a non-porous film by a coating process, a mixed resin solution similar to that used in the lamination processes is coated directly onto the fine porous film by a coating machine such as a knife over roll coater. The coated mixed resin solution is then dried at a temperature of 100°–160° C. using an air oven and so forth to obtain a non-porous film. Pre-treatment and post-treatment of the fabric should be performed in the same manner as in the case of the lamination processes.

The film surface of the non-porous film obtained by this coating process is susceptible to the effects of fiber material irregularities and the fine porous film. Since film thickness also tends to not be uniform, there are many cases in which durability is somewhat inferior to films obtained with a lamination process. In addition, tucks also tend to form easily. In the case of obtaining a film according to a lamination process, since a film is formed on mold releasing paper, a non-porous film can be obtained that has a smooth film surface and uniform film thickness. As a result, this film has durability and enables the production of a fabric of stable quality. Moreover, in processes wherein adhesion is performed by applying a moisture-permeable adhesive in the form of either points or lines, fabric can be obtained having excellent moisture permeability in comparison with applying adhesive over the entire surface. In addition, moisture-permeable, waterproof fabric obtained by thermocompression bonding without using an adhesive demonstrates remarkably superior water resistance, moisture permeability and durability, and with respect to durability, has a water resistance pressure retention ratio of better than 90% even after ten washings.

Moreover, in the case of a moisture-permeable, waterproof fabric wherein at least one layer of a fine porous film, composed of a mixture of a fluorine-containing polyurethane resin and a polyurethane resin having a low degree of polymerization, and a non-porous film having for its main component a polymer material that swells in water are adhered without having an adhesive layer between one textile base material and another textile base material, water resistance pressure is better than 50,000 $mmH_2O$ and water vapor permeability as measured with the potassium acetate method is better than 10,000 $g/m^2/24$ hours, while that measured with the calcium chloride is 3,000 $g/m^2/24$ hours. Moreover, this fabric also demonstrates dewing inhibition, with the amount of dewing being less than 30 $g/m^2/hr$, and a water resistance pressure retention ratio after washing of better than 90%.

Furthermore, the evaluation of quality described in this specification was performed in accordance with the following methods.

1) Water Vapor Permeability

Measured according to method A-1 (calcium chloride method) and method B-1 (potassium acetate method) of JIS L 1099 while converting indications to 24 hours.

2) Water Resistance Pressure

Measured according to method B of JIS L 1092. In addition, method 103 of JIS L 0217 was used for the washing method when water resistance pressure retention ratio following washing was measured, and water resistance pressures before washing and after ten washings were compared.

3) Moisture Condensation

A 500 ml beaker containing 500 ml of warm water at 40° C. was covered with the sample so that the resin coating surface faced the inside of the beaker, and the sample was held in position with a rubber band. The beaker was allowed to stand for 1 hour in a thermohygrostat under conditions of 10° C. and 60% humidity. The amount of water droplets adhered to the resin coating surface after 1 hour was measured and taken to be the amount of dewing. Values were converted into units of $g/m^2/hr$.

4) Separation Strength

Measured according to the method of JIS K 6328.

The following provides an additional explanation of the present invention through its examples. In the examples, the term "parts" refers to parts by weight.

EXAMPLE 1

A flat woven fabric, obtained by weaving cationic dyeable polyester filament fibers composed of 100 d/48 f at a density of 95 fibers/inch breadthwise and 80 fibers/inch lengthwise, was dyed by ordinary methods. Next, the woven fabric was impregnated with a 5% aqueous solution of Asahi Guard AG710 (trade name of a water repellent manufactured by Asahi Glass Co., Ltd.), wrung out with a mangle, dried and heat treated for 30 seconds at 150° C.

The following resin composition was blended for coating.

| | |
|---|---|
| Fluorine-containing urethane resin (solid portion: 25%) | 80 parts |
| Low polymerization urethane resin (molecular weight: 30,000, solid portion: 40%) | 20 parts |
| Dimethylformamide | 80 parts |
| Fine calcium carbonate powder | 3 parts |

The urethane resin was coated onto the woven fabric using a knife over roll coater and by setting the slit between the woven fabric and knife to 0.10 mm.

After guiding this through water and coagulating the resin for 2 minutes, the woven fabric was washed for 5 minutes in warm water at 50° C., and dried using a tenter.

Dik Guard F341 (trade name, water repellent manufactured by Dainippon Ink Inc.) was impregnated into the coated woven fabric in the form of a 5% trichloroethane solution to waterproof the urethane resin layer. The woven fabric was then wrung out with a mangle, dried and heat treated for 30 seconds at 150° C.

The performance of the resulting waterproof fabric is shown in Table 1.

A moisture-permeable, waterproof fabric was obtained that demonstrated excellent qualities in all areas, including water vapor permeability, water resistance pressure, moisture condensation and separation strength.

COMPARATIVE EXAMPLE 1

The same woven fabric as used in Example 1 was used as a fabric for coating processing.

The urethane resin to be coated was changed to the following blending composition to obtain a waterproof fabric using a process completely identical to that of Example 1.

| | |
|---|---|
| Fluorine-containing urethane resin (solid portion: 25%) | 100 parts |
| Dimethylformamide | 80 parts |
| Fine calcium carbonate powder | 3 parts |

The performance of the resulting waterproof fabric is shown in Table 1.

Although water vapor permeability is high, performance was inadequate with respect to water resistance and separation strength.

EXAMPLE 2

A twill woven fabric, obtained by weaving Nylon filament fibers composed of 70 d/68 f for the weft and 210 d/68 f for the warp at a density of 226 fibers/inch breadthwise and 78 fibers/inch lengthwise, was dyed by ordinary methods. Next, the woven fabric was impregnated with a 5% aqueous solution of Asahi Guard AG710, wrung out with a mangle, dried and heat treated for 30 seconds at 150° C.

The following resin composition was blended for coating.

| | |
|---|---|
| Fluorine-containing urethane resin (solid portion: 25%) | 70 parts |
| Low polymerization urethane resin (molecular weight: 30,000, solid portion: 40%) | 30 parts |

-continued

| | |
|---|---|
| Dimethylformamide | 40 parts |
| Colloidal silica | 3 parts |

The urethane resin was coated onto the woven fabric using a knife over roll coater with the slit between the woven fabric and knife set to 0.10 mm.

After guiding this through water and coagulating the resin for 2 minutes, the woven fabric was washed for 5 minutes in warm water at 50° C. and dried using a tenter.

Dik Guard F341 was impregnated into the coated woven fabric in the form of a 5% trichloroethane solution to waterproof the urethane resin layer. The woven fabric was then wrung out with a mangle, dried and heat treated for 30 seconds at 150° C.

The performance of the resulting waterproof fabric is shown in Table 1.

A moisture-permeable, waterproof fabric was obtained that had both high water resistance and water vapor permeability.

EXAMPLE 3

A polyester filament composed of 75 d/72 f was woven at 170 filaments/inch breadthwise and 86 filaments/inch lengthwise to obtain a high-density, flat woven fabric. This woven fabric was refined and dyed to prepare the fabric to be coated. Pre-treatment in the form of calendering was performed at a temperature of 150° C. and pressure of 4 kg/cm$^2$. Moreover, the woven fabric was impregnated with an 8% aqueous solution of Asahi Guard AG730 (trade name, water repellent manufactured by Asahi Glass Co., Ltd.). After wringing the woven fabric out with a mangle and drying the fabric, heat treatment was provided for 30 seconds at 160° C.

The following blend composition was prepared for the urethane resin.

| | |
|---|---|
| Fluorine-containing urethane resin (solid portion: 25%) | 85 parts |
| Low polymerization urethane resin (molecular weight: 20,000, solid portion: 40%) | 15 parts |
| Dimethylformamide | 70 parts |
| Fine cellulose powder | 3 parts |
| Sodium dioctylsulfosuccinate (solid portion: 70%) | 1 part |

The urethane resin was coated onto the woven fabric using a knife over roll coater and by setting the slit between the woven fabric and knife to 0.10 mm followed by congealing the resin for 5 minutes in water and washing for 5 minutes in warm water at 500C. After drying being dried in a cylinder dryer, the coated woven fabric was impregnated with a 5% mineral turpentine solution of Asahi Guard AG690 (trade name of a water repellent manufactured by Asahi Glass Co., Ltd.). After being wrung out with a mangle and dried, the coated woven fabric was heat treated for 30 seconds at 160° C. using a tenter.

The performance of the resulting waterproof fabric is shown in Table 1.

A moisture-permeable, waterproof fabric was obtained that had both high water resistance and water vapor permeability.

COMPARATIVE EXAMPLE 2

The same woven fabric as used in Example 3 was used as a fabric for coating processing.

The urethane resin to be coated was changed to the following blended composition to obtain a waterproof fabric using a process completely identical to that of Example 1.

| | |
|---|---|
| Low polymerization urethane resin (molecular weight: 20,000, solid portion: 40%) | 100 parts |
| Dimethylformamide | 70 parts |
| Fine cellulose powder | 3 parts |
| Sodium dioctylsulfosuccinate (solid portion: 70%) | 1 part |

The results of evaluating the quality of the resulting fabric are shown in Table 1.

Although water resistance and separation strength are high, water vapor permeability and moisture condensation are low, resulting in a waterproof fabric that lacks comfort when worn.

COMPARATIVE EXAMPLE 3

The same woven fabric as used in Example 3 was used as a fabric for coating processing.

The urethane resin blended into the fluorine-containing urethane resin was changed from that having a low degree of polymerization to that having a high degree of polymerization, and then blended, as shown below, to obtain a waterproof fabric according to a process completely identical to that in Example 3.

| | |
|---|---|
| Fluorine-containing urethane resin (solid portion: 25%) | 85 parts |
| High polymerization urethane resin (molecular weight: 80,000, solid portion: 40%) | 15 parts |
| Dimethylformamide | 70 parts |
| Fine cellulose powder | 3 parts |
| Sodium dioctylsulfosuccinate (solid portion: 70%) | 1 part |

The results of measuring the quality of the resulting fabric are shown in Table 1.

Since this fabric has low separation strength and the decrease in water resistance pressure after washing is large, it lacks practical applicability as a waterproof fabric.

EXAMPLE 4

A polyester woven fabric (flat woven fabric, fibers used: 75 d/72 f, density: 180 fibers/inch lengthwise, 94 fibers/inch breadthwise) was scored by ordinary methods, dyed and impregnated with a 5% aqueous solution of Asahi Guard AG710. The woven fabric was then wrung out with a mangle, dried and heat treated for 30 seconds at 150° C.

Next, a mixed resin solution blended as shown below was coated onto the fabric using a knife over roll coater. After guiding the fabric through water at 20° C. and coagulating the resin for 2 minutes, the woven fabric was washed for 5 minutes in warm water at 50° C. followed by drying in an air oven at 130° to obtain a fine porous film of resin having a film thickness of 20 μm.

| Mixed Resin Solution for Fine Porous Film | |
|---|---|
| Fluorine-containing urethane resin (solid portion: 25%) | 70 parts |
| Low polymerization urethane resin (molecular weight: 30,000, solid | 30 parts |

-continued

| Mixed Resin Solution for Fine Porous Film | |
|---|---|
| portion: 40%) | |
| Dimethylformamide | 40 parts |
| Colloidal silica | 3 parts |

Next, the following mixed resin solution was prepared for the non-porous film.

| Mixed Resin Solution for Non-Porous Film | |
|---|---|
| Thermocompressible polyurethane resin (solid portion: 30%) | 20 parts |
| Water swelling polyurethane resin (water line degree of swelling: 17%, solid portion: 30%) | 80 parts |
| Methyl ethyl ketone | 70 parts |
| Dimethylformamide | 10 parts |

The above-mentioned mixed resin solution was coated onto the entire surface of Furdal releasing paper EV130TPD (trade name, Rintech Co., Ltd.) using a knife over roll coater. The resin on the releasing paper was dried at 100° C. using an air oven to obtain a non-porous resin film having a film thickness of 10 μm. Moreover, after preheating to 120° C. using an air oven, this non-porous film was thermocompression bonded at 120° C. and 4 kg/cm$^2$ to a fine porous film of a fiber material provided with the above-mentioned fine porous film preheated to 120° C.

Following thermocompression bonding, the releasing paper was immediately peeled off and the coated fabric was given a water repellent treatment using Asahi Guard AG690. After finishing setting at 140° C., paper treatment was performed to obtain a moisture-permeable, waterproof fabric. The physical properties of the resulting moisture-permeable, waterproof fabric are shown in Table 2.

EXAMPLE 5

A polyester woven fabric (flat woven fabric, fibers used: 75 d/72 f, density: 180 fibers/inch lengthwise, 94 fibers/inch breadthwise) was scored by ordinary methods, dyed and impregnated with a 5% aqueous solution of Asahi Guard AG710. The woven fabric was then wrung out with a mangle, dried and heat treated for 30 seconds at 150° C.

Next, a mixed resin solution, blended as shown below, was coated onto the fabric using a knife over roll coater. After guiding the fabric through water at 20° C. and coagulating the resin for 2 minutes, the woven fabric was washed for 5 minutes in warm water at 50° C. and dried in an air oven at 130° to obtain a fine porous resin film having a film thickness of 20 μm.

| Mixed Resin Solution for Fine Porous Film | |
|---|---|
| Fluorine-containing urethane resin (solid portion: 25%) | 70 parts |
| Low polymerization urethane resin (molecular weight: 30,000, solid portion: 40%) | 30 parts |
| Dimethylformamide | 40 parts |
| Colloidal silica | 3 parts |

Next, the following mixed resin solution was prepared for the non-porous film.

| Mixed Resin Solution for Non-Porous Film | |
|---|---|
| Water swelling polyurethane resin (degree of linear water swelling: 30%, solid portion: 25%) | 100 parts |
| Isocyanate crosslinking agent | 4 parts |

The solution was then coated onto a fine porous film on a woven fabric having the above-mentioned fine porous film using a knife over roll coater and dried at 120° C. The thickness of the resulting non-porous film was 5 μm.

Next, a water repellent treatment was performed using Asahi Guard AG690 followed by finishing setting, at 140° C., and paper treatment to obtain a moisture-permeable, waterproof fabric.

The physical properties of the resulting moisture-permeable, waterproof fabric are shown in Table 2.

EXAMPLE 6

A polyester woven fabric (flat woven fabric, fibers used: 75 d/72 f, density: 180 fibers/inch lengthwise, 94 fibers/inch breadthwise) was scored by ordinary methods, dyed and impregnated with a 5% aqueous solution of Asahi Guard AG710. The woven fabric was then wrung out with a mangle and dried followed by heat treatment for 30 seconds at 150° C.

Next, a mixed resin solution blended as shown below was coated using a knife over roll coater. After guiding the fabric through water at 20° C. and coagulating the resin for 2 minutes, the woven fabric was washed for 5 minutes in warm water at 50° C., followed by drying in an air oven at 130°, to obtain a fine porous resin film having a film thickness of 20 μm.

| Mixed Resin Solution for Fine Porous Film | |
|---|---|
| Fluorine-containing urethane resin (solid portion: 25%) | 70 parts |
| Low polymerization urethane resin (molecular weight: 30,000, solid portion: 40%) | 30 parts |
| Dimethylformamide | 40 parts |
| Colloidal silica | 3 parts |

Next, the following mixed resin solution was prepared for the non-porous film.

| Mixed Resin Solution for Non-Porous Film | |
|---|---|
| Thermocompressible polyurethane resin (solid portion: 30%) | 20 parts |
| Water swelling polyurethane resin (degree of linear water swelling: 30%, solid portion: 30%) | 80 parts |
| Methyl ethyl ketone | 70 parts |
| Dimethylformamide | 10 parts |

This resin solution was coated onto the entire surface of Furdal releasing paper EV130TPD using a knife over roll coater. The resin on the releasing paper was dried at 100° C. using an air oven to obtain a non-porous resin film having a film thickness of 10 μm. Moreover, after preheating at 120° C. using an air oven, this non-porous film was thermocompression bonded at 120° C. and 4 kg/cm$^2$ to a fine porous film on a woven fabric having the above-mentioned fine porous film preheated to 120° C.

Next, the releasing paper was immediately peeled off and a water repellent treatment was applied using Asahi Guard AG690. After finishing setting at 140° C., paper treatment was performed to obtain a moisture-permeable, waterproof fabric.

The physical properties of the resulting moisture-permeable, waterproof fabric are shown in Table 2.

EXAMPLE 7

A polyester woven fabric (flat woven fabric, fibers used: 75 d/72 f, density: 180 fibers/inch lengthwise, 94 fibers/inch breadthwise) was scored by ordinary methods, dyed and impregnated with a 5% aqueous solution of Asahi Guard AG710. The woven fabric was then wrung out with a mangle, dried and heat treated for 30 seconds at 150° C.

Next, a mixed resin solution blended as shown below was coated onto the fabric using a knife over roll coater. After guiding this fabric through water at 20° C. and coagulating the resin for 2 minutes, the woven fabric was washed for 5 minutes in warm water at 50° C., followed by drying in an air oven at 130°, to obtain a fine porous resin film having a film thickness of 20 μm.

| Mixed Resin Solution for Fine Porous Film | |
|---|---|
| Fluorine-containing urethane resin (solid portion: 25%) | 70 parts |
| Low polymerization urethane resin (molecular weight: 30,000, solid portion: 40%) | 30 parts |
| Dimethylformamide | 40 parts |
| Colloidal silica | 3 parts |

Next, the following mixed resin solution was prepared for the non-porous film.

| Mixed Resin Solution for Non-Porous Film | |
|---|---|
| Water swelling, thermocompressible polyurethane resin (degree of linear water swelling: 17%, solid portion: 30%) | 100 parts |
| Methyl ethyl ketone | 70 parts |
| Dimethylformamide | 10 parts |

This resin solution was coated onto the entire surface of Furdal releasing paper EV13OTPD using a knife over roll coater. The resin on the releasing paper was dried at 100° C., using an air oven, to obtain a non-porous resin film having a film thickness of 10 μm. Moreover, after preheating at 120° C. using an air oven, this non-porous film was thermocompression bonded, at 120° C. and 4 kg/cm$^2$, to a fine porous film on a woven fabric in which the above-mentioned fine porous film was preheated to 120° C.

Next, the releasing paper was immediately peeled off and a water repellent treatment, using Asahi Guard AG690, was applied. After finishing setting at 140° C., paper treatment was performed to obtain a moisture-permeable, waterproof fabric.

The physical properties of the resulting moisture-permeable, waterproof fabric are shown in Table 2.

EXAMPLE 8

A polyester woven fabric (flat woven fabric, fibers used: 75 d/72 f, density: 180 fibers/inch lengthwise, 94 fibers/inch breadthwise) was refined by ordinary methods, dyed and impregnated with a 5% aqueous solution of Asahi Guard AG710. The woven fabric was then wrung out with a mangle, dried and heat treated for 30 seconds at 150° C.

Next, a mixed resin solution blended as shown below was coated using a knife over roll coater. After guiding the fabric through water at 20° C. and coagulating the resin for 2 minutes, the woven fabric was washed for 5 minutes in warm water at 50° C. and dried in an air oven at 130° to obtain a fine porous film having a resin film thickness of 20 μm.

| Mixed Resin Solution for Fine Porous Film | |
|---|---|
| Fluorine-containing urethane resin (solid portion: 25%) | 70 parts |
| Low polymerization urethane resin (molecular weight: 30,000, solid portion: 40%) | 30 parts |
| Dimethylformamide | 40 parts |
| Colloidal silica | 3 parts |

Next, the following mixed resin solution was prepared for the non-porous film.

| Mixed Resin Solution for Non-Porous Film | |
|---|---|
| Thermocompressible polyurethane resin (solid portion: 30%) | 20 parts |
| Water swelling polyurethane resin (degree of linear water swelling: 17%, solid portion: 30%) | 80 parts |
| Methyl ethyl ketone | 70 parts |
| Dimethylformamide | 10 parts |

This resin solution was coated onto the entire surface of Furdal releasing paper EV130TPD using a knife over roll coater. The resin on the releasing paper was dried at 100° C., using an air oven, to obtain a non-porous resin film having a film thickness of 10 μm.

Next, after applying a moisture-permeable adhesive having the following composition:

| | |
|---|---|
| Two-liquid type polyurethane resin (solid portion: 60%) | 100 parts |
| Isocyanate crosslinking agent | 10 parts |
| Methyl ethyl ketone | 10 parts |
| Toluene | 70 parts |

onto a non-porous film, in dotted form, using a gravure roll coater, the film was dried at 100° C. Next, the film was thermocompression bonded, at 120° C. and 4 kg/cm$^2$, to a Nylon knitted fabric (20 d/7 f, 28 gauge) preheated to 100° C. After aging for 20 hours, the releasing paper was peeled off to obtain a laminated fabric having a non-porous film layer.

Moreover, the fine porous film surface of a coated fabric having a fine porous film was thermocompression bonded, at 120° C. and 4 kg/cm$^2$, to the non-porous film surface of a laminated fabric having a non-porous film.

The releasing paper was peeled off and a water repellent treatment, using Asahi Guard AG690, was applied. After finishing setting at 140° C., paper treatment was performed to obtain a moisture-permeable, waterproof fabric.

The physical properties of the resulting laminated fabric are shown in Table 2.

EXAMPLE 9

A polyester woven fabric (flat woven fabric, fibers used: 75 d/72 f, density: 180 fibers/inch lengthwise, 94 fibers/inch breadthwise) was refined by ordinary methods, dyed and impregnated with a 5% aqueous solution of Asahi Guard AG710. The woven fabric was then wrung out with a mangle, dried and heat treated for 30 seconds at 150° C.

Next, a mixed resin solution blended as shown below was coated onto the fabric using a knife over roll coater. After guiding the fabric through water at 20° C. and coagulating the resin for 2 minutes, the woven fabric was washed for 5 minutes in warm water at 50° C. and dried in an air oven at 130° to obtain a fine porous resin film having a film thickness of 20 μm.

| Mixed Resin Solution for Fine Porous Film | |
|---|---|
| Fluorine-containing urethane resin (solid portion: 25%) | 70 parts |
| Low polymerization urethane resin (molecular weight: 30,000, solid portion: 40%) | 30 parts |
| Dimethylformamide | 40 parts |
| Colloidal silica | 3 parts |

Next, the following mixed resin solution was prepared for the non-porous film.

| Mixed Resin Solution for Non-Porous Film | |
|---|---|
| Thermocompressible polyurethane resin (degree of linear water swelling: 1%, solid portion: 30%) | 100 parts |
| Methyl ethyl ketone | 70 parts |
| Dimethylformamide | 10 parts |

This resin solution was coated onto the entire surface of Furdal releasing paper EV13OTPD using a knife over roll coater. The resin on the releasing paper was dried at 100° C., using an air oven, to obtain a non-porous resin film having a film thickness of 10 μm.

Next, after applying a moisture-permeable adhesive having the following composition:

| | |
|---|---|
| Two-liquid type polyurethane resin (solid portion: 60%) | 100 parts |
| Isocyanate crosslinking agent | 10 parts |
| Methyl ethyl ketone | 10 parts |
| Toluene | 70 parts |

onto a non-porous film in point form using a gravure roll coater, the film was dried at 100° C. Next, the film was thermocompression bonded, at 120° C. and 4 kg/cm$^2$, to a Nylon knitted fabric (20 d/7 f, 28 gauge) preheated to 100° C. After aging for 20 hours, the releasing paper was peeled off to obtain a laminated fabric having a non-porous film layer.

Moreover, the fine porous film surface of a coated fabric having a fine porous film was thermocompression bonded, at 120° C. and 4 kg/cm$^2$, to the non-porous film surface of a laminated fabric having a non-porous film.

The releasing paper was peeled off the fabric was given a water repellent treatment using Asahi Guard AG690. After finishing setting at 140° C., a paper treatment was performed to obtain a moisture-permeable, waterproof fabric.

The physical properties of the resulting laminated fabric are shown in Table 2.

TABLE 1

| | Water Vapor Permeability g/m$^2$/24 hrs | Water Resistance Pressure mmH$_2$O Start | Water Resistance Pressure mmH$_2$O After 10 HL[1)] | Amount of Moisture Condensation g/m$_2$/hr | Separation Strength g/cm |
|---|---|---|---|---|---|
| Ex. 1 | 11500 | 11000 | 8000 | 10 | 500 × 450 |
| Comp. Ex. 1 | 10200 | 4000 | 1900 | 15 | 50 × 20 |
| Ex. 2 | 12000 | 7000 | 5200 | 10 | 600 × 670 |
| Ex. 3 | 13000 | 8000 | 6100 | 5 | 350 × 590 |
| Comp. Ex. 2 | 3100 | 12000 | 9000 | 80 | 620 × 590 |
| Comp. Ex. 3 | 10600 | 7000 | 3500 | 10 | 200 × 220 |

[1)]10 HL refers to performing the washing method specified in JIS L 0217 ten times.

TABLE 2

| | Structure of Moisture-Permeable, Waterproof Fabric | Form of Providing Non-Porous film | Water Vapor Permeability (g/m$^2$/24 hr) Calcium chloride method | Water Vapor Permeability (g/m$^2$/24 hr) Potassium acetate method | Water Resistance Pressure (mmH$_2$O) Start | Water Resistance Pressure (mmH$_2$O) After 10 washings | Amt. of Moisture Condensation (g/m$^2$/hr) |
|---|---|---|---|---|---|---|---|
| Ex. 4 | Ground fabric + fine porous film + water swelling non-porous film | Lamination | 5500 | 12300 | 32000 | 32000 | 5 |
| Ex. 5 | Ground fabric + fine porous film + water swelling non-porous film | Coating | 7600 | 12000 | 30000 | 20000 | 25 |
| Ex. 6 | Ground fabric + fine porous film + water swelling non-porous film | Lamination | 6800 | 12500 | 31000 | 31000 | 25 |
| Ex. 7 | Ground fabric + fine porous film + water swelling non-porous film | Lamination | 5900 | 14200 | 33000 | 33000 | 5 |
| Ex. 8 | Ground fabric + fine porous film + water swelling non-porous film + adhesive + base material | | 5200 | 10100 | 54000 | 54000 | 10 |

TABLE 2-continued

| | Structure of Moisture-Permeable, Waterproof Fabric | Form of Providing Non-Porous film | Water Vapor Permeability ($g/m^2/24$ hr) Calcium chloride method | Potassium acetate method | Water Resistance Pressure ($mmH_2O$) Start | After 10 washings | Amt. of Moisture Condensation ($g/m^2/hr$) |
|---|---|---|---|---|---|---|---|
| Ex. 9 | Ground fabric + fine porous film + water swelling non-porous film + adhesive + base material | | 3000 | 2800 | 53000 | 53000 | 65 |

INDUSTRIAL APPLICABILITY

According to the present invention as described above, the present invention is able to provide a moisture-permeable, waterproof fabric having excellent durability and excellent performance with respect to water vapor permeability, water resistance and dewing inhibition. Thus, in the case of using the moisture-permeable, waterproof fabric of the present invention in clothing, tents and so forth, work and exercise can be performed in a comfortable working environment, without stickiness appearing inside the clothing or tent, even when working in a severe environment or during strenuous exercise.

In addition, the present invention is also able to provide a production process for a moisture-permeable, waterproof fabric having good compatibility between the fluorine-containing polyurethane resin and the polyurethane resin having a low degree of polymerization during processing, as well as excellent workability and productivity.

We claim:

1. A moisture-permeable, waterproof fabric comprising a first textile fabric, a first resin coating comprising a fluorine-containing polyurethane resin and a polyurethane resin having a number average molecular weight from 1,000 to 50,000, and a second resin coating comprising a water swelling polymer material.

2. The fabric according to claim 1, having a water resistance pressure of greater than 6,000 $mmH_2O$ as measured by method B of JIS L 1092 and a water vapor permeability of greater than 8,000 $g/m^2/24$ hours as measured by method A-1 of JIS L 1099.

3. The fabric according to claim 1, wherein said water swelling polymer material is thermocompressable.

4. The fabric according to claim 1, having a water resistance pressure of greater than 30,000 $mmH_2O$ as measured by method B of JIS L 1092 and a water vapor permeability of greater than 10,000 $g/m^2/24$ hours as measured by method B-1 of JIS L 1099.

5. The fabric according to claim 1, having a moisture condensation amount of less than 30 $g/m^2/hr$.

6. The fabric according to claim 1, having a water resistance pressure retention ratio after washing of greater than 70%.

7. The fabric according to claim 1, further comprising a second textile fabric.

8. The fabric according to claim 7, wherein said first resin coating and said second resin coating are present between said first textile fabric and said second textile fabric.

9. A process for preparing a moisture-permeable, waterproof fabric comprising the steps of:

(a) coating a resin solution comprising a fluorine-containing polyurethane resin and a polyurethane resin having a number average molecular weight from 1,000 to 50,000 on a textile fabric;

(b) coagulating said resin solution;

(c) removing solvent from said resin solution;

(d) drying said textile fabric to obtain a first resin coating comprising said fluorine-containing polyurethane resin and said polyurethane resin having a number average molecular weight from 1,000 to 50,000 thereon;

(e) treating said dried textile fabric with a water repellent; and (f) bonding a second resin coating comprising a water swelling polymer material to said first resin coating by thermocompression.

* * * * *